United States Patent [19]

Schreiber

[11] Patent Number: 4,811,007

[45] Date of Patent: Mar. 7, 1989

[54] HIGH RESOLUTION VIDEO GRAPHICS SYSTEM

[75] Inventor: Paul Schreiber, Fort Worth, Tex.

[73] Assignee: Tandy Corporation, Fort Worth, Tex.

[21] Appl. No.: 98,709

[22] Filed: Sep. 21, 1987

Related U.S. Application Data

[63] Continuation of Ser. No. 823,206, Jan. 28, 1986, abandoned, which is a continuation of Ser. No. 556,178, Nov. 29, 1983, abandoned.

[51] Int. Cl.[4] ..... G09G 1/00

[52] U.S. Cl. ..... 340/747; 340/703; 340/798

[58] Field of Search ..... 340/703, 747, 750, 798, 340/799; 364/518, 521

[56] References Cited

U.S. PATENT DOCUMENTS

| | | | |
|---|---|---|---|
| 3,967,246 | 6/1976 | House | 364/200 |
| 4,016,544 | 5/1977 | Morita et al. . | |
| 4,150,364 | 4/1979 | Baltzer . | |
| 4,342,029 | 7/1982 | Hofmanis et al. . | |
| 4,418,343 | 11/1983 | Ryan et al. | 340/799 |
| 4,418,344 | 11/1983 | Brown | 340/750 |
| 4,439,759 | 3/1984 | Fleming et al. | 340/703 |
| 4,498,081 | 2/1985 | Fukushima et al. | 340/799 |
| 4,503,429 | 3/1985 | Schreiber | 340/799 |
| 4,509,043 | 4/1985 | Mossaides | 340/703 |
| 4,511,965 | 4/1985 | Rajaram | 340/703 |
| 4,554,538 | 11/1985 | Bieneman | 340/703 |

FOREIGN PATENT DOCUMENTS

| | | |
|---|---|---|
| 0085480 | 8/1983 | European Pat. Off. . |
| 0105724 | 4/1984 | European Pat. Off. . |
| 2463555 | 2/1981 | France . |
| 2073997 | 10/1981 | United Kingdom . |
| 2090506 | 7/1982 | United Kingdom . |
| 2112256 | 7/1983 | United Kingdom . |

*Primary Examiner*—John W. Caldwell, Sr.
*Assistant Examiner*—Jeffery A. Brier
*Attorney, Agent, or Firm*—Wolf, Greenfield & Sacks

[57] ABSTRACT

A high resolution video graphics system for use with a processor and characterized by improved memory expandability particularly in connection with color display. The high resolution video graphics system includes a video memory which is preferably comprised of a plurality of video memory planes and video counter means for providing display timing. There are basically four buses that are used with the system including a control bus, a read bus, a write bus, and an address bus. A multiplexer means is provided for receiving either video counter addresses or direct addresses from the processor. There is associated with the video memory means for converting to serial output data which the preferred embodiment includes a series of shift registers corresponding to the number of separate memory planes employed. In the preferred embodiment the system has three memory planes, each of 16K by 16 capacity. The shift register output is coupled to a high speed static palette RAM with the shift register outputs being the addresses thereto. The data outputs of the palette RAM couple to guns on a color monitor or to the back plane in connection with black and white graphics.

3 Claims, 11 Drawing Sheets

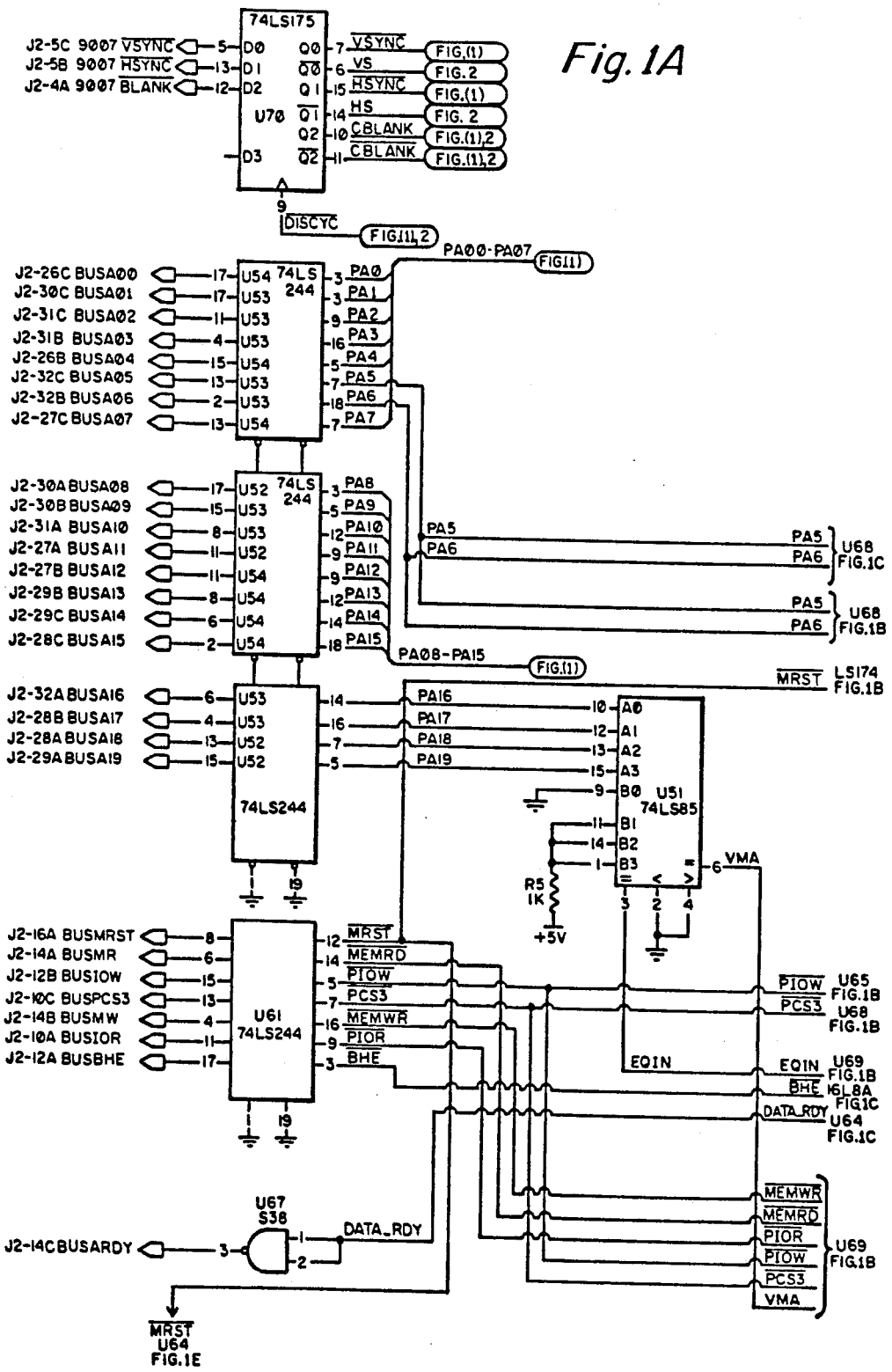
Fig. 1A
74LS175
U70
J2-5C 9007 VSYNC
J2-5B 9007 HSYNC
J2-4A 9007 BLANK
VSYNC
VS
HSYNC
HS
CBLANK
CBLANK
FIG.(1)
FIG.2
FIG.(1)
FIG.2
FIG.(1),2
FIG.(1),2
DISCYC
FIG.(1),2
PA00-PA07
FIG.(1)
74LS 244
U54
U53
U52
J2-26C BUSA00
J2-30C BUSA01
J2-31C BUSA02
J2-31B BUSA03
J2-26B BUSA04
J2-32C BUSA05
J2-32B BUSA06
J2-27C BUSA07
PA0
PA1
PA2
PA3
PA4
PA5
PA6
PA7
J2-30A BUSA08
J2-30B BUSA09
J2-31A BUSA10
J2-27A BUSA11
J2-27B BUSA12
J2-29B BUSA13
J2-29C BUSA14
J2-28C BUSA15
PA8
PA9
PA10
PA11
PA12
PA13
PA14
PA15
PA08-PA15
FIG.(1)
PA5
PA6
U68
FIG.1C
U68
FIG.1B
MRST
LS174
FIG.1B
J2-32A BUSA16
J2-28B BUSA17
J2-28A BUSA18
J2-29A BUSA19
74LS244
PA16
PA17
PA18
PA19
U51
74LS85
A0
A1
A2
A3
B0
B1
B2
B3
VMA
R5
1K
+5V
J2-16A BUSMRST
J2-14A BUSMR
J2-12B BUSIOW
J2-10C BUSPCS3
J2-14B BUSMW
J2-10A BUSIOR
J2-12A BUSBHE
U61
74LS244
MRST
MEMRD
PIOW
PCS3
MEMWR
PIOR
BHE
PIOW
PCS3
U65
FIG.1B
U68
FIG.1B
EQIN
EQIN
U69
FIG.1B
BHE
16L8A
FIG1C
DATA_RDY
U64
FIG.1C
MEMWR
MEMRD
PIOR
PIOW
PCS3
VMA
U69
FIG.1B
U67
S38
J2-14C BUSARDY
DATA_RDY
MRST
U64
FIG.1E +5V
R4
1K
FIG.1C SCNCLK
U32
74F161
U33
74F161
U50
74F161
U49
74F161
R0
R1
R2
R3
R3
1K
+5V
R4
R5
R6
R7
PIN8
U48

C0
C1
C2
C3
C4
C5
74F153
U34
U35
U36
U37
VA7
VA6
VA5
VA4
VA3
VA2
VA1
VA0

FIG.1C MUX
FIG.1C 186/SCN
MUX
186/SCN

U6 TMS4416-150
U7 TMS4416-150
U8 TMS4416-150
U9 TMS 4416-150
U25 74LS273
U23 74LS273
U24 25LS22
U22 25LS22
U44 74F245
U41 74F245
RP3 27ΩRPAC
RP4 33ΩRPAC
DOTCLK FIG.2B
W2BUS VA0R-VA7R FIG.2C
RASR FIG.2B
CASILR CASIHR VWRR FIG.2B
CAS2LR CAS2HR FIG.2C
VA0-VA7 FIG.1,(2)
+5V
1K

G/Ā
J2-4B
FIG1,(2)
CBLANK
U30
F08
U1
125
AGVID
J2-2B
AINT
J2-6C
+5V
R8
1K
S38
U67
S38
FIG.1,(2)
G/Ā
P0VID
FIG.(2)
WR-PAL
FIG.(2)
U18
F04
1K
+5V

PA1
U17
74F257
U16
74S189A
CS

PA2
+5V
1K
FIG.(2)
P1VID
U17
74F257

PA3
+5V
1K
FIG.(2)
P2VID
U17
74F257

WR-PM
RD0
RD1
RD2
RD3
D01
D02
D03
D04
BLUV
GRNV
REDV
INTV
U15
128
BLU-V
J1-5
GRN-V
J1-4
U14
128
RED-V
J1-3
INT-V
J1-6

HS
HS-OUT
J1-8

VS
VS-OUT
J1-9
J1-1
J1-2

CBLANK
F00

G/Ā
U47
LS164
U63
9007BLANK

DOTCLK

RD-BUS

HIGH RESOLUTION VIDEO GRAPHICS SYSTEM

This application is a continuation, of application Ser. No. 06/823,206, filed 1-28-86, now abandoned which in turn is a continuation of application Ser. No. 06/556,178, filed 11-29-83 now abandoned.

INTRODUCTION TO THE INVENTION

The present invention relates in general to a high resolution video graphics system. More particularly, the invention pertains to such a high resolution system that is adapted for display of either a black and white or color format and which is expandable in the number of colors displayed.

Among the objects of the present invention is an object to provide a new and unique bus architecture referred to herein as a split bus system. The split bus system in particular pertains to the system write bus which is split into a plurality of separate buses corresponding to the number of memory planes employed.

Another object of the present invention is to provide a high resolution video graphics system which is readily expandable in both the number of memory planes employed and memory width. The greater the number of memory planes employed the greater the number of colors that can be derived. As far as width is concerned this may be, for example in widths of 8, 16 or 32 bits.

A further object of the present invention is to provide a high resolution video graphics system interfacing with a processor to form a part of an overall computer system and in which the high resolution graphics is substantially entirely transparent as far as the processor is concerned.

Still another object of the present invention is to provide an improved high resolution video graphics system in which the number of memory addresses does not change with the number of memory planes employed. The same number of memory addresses are used regardless of the number of memory planes that are employed.

Still another object of the present invention is to provide improved memory control circuitry which is instrumental in providing maximum access speed using only a relatively small number of component circuits.

To accomplish the foregoing and other objects of this invention there is provided a high resolution video graphics system adapted for use in a computer system employing a processor. The video portion of the system has the capability of displaying both graphics and alpha numeric characters. The system employs a unique split bus architecture. The split bus system is advantageous in reducing the total number of parts employed and also enables expandability of the system particularly with respect to the number of memory planes that are employed. With this technique there is provided very fast screen updates. The split bus architecture means that there are actually a plurality of write buses. In addition to this there is also a read bus, a control bus and an address bus. The control bus couples signals from the processor to the high resolution video graphics circuitry. Typically, the control bus couples such signals as memory read and write signals, peripheral select signals and data ready signals. These signals are buffered and decoded to provide the proper memory timing.

The data communication between the processor and the graphics memory is provided by the read and write buses. It is noted that the read bus is isolated from the write bus so that the processor may read the graphics memory while displaying data to the screen all occurring simultaneously. In order to accomplish this the write bus is preferably split from the read bus by a buffer means. The write bus split into separate write busses then couples to the memory planes. The write bus goes directly to the black and white plane which has been identified as plane 0 and is gated by bidirectional buffers splitting the bus into second and third buses for coupling to the respective buses. The address bus, which is coupled from the processor is used to read and write graphics data. The addresses for the display data since they are sequential, are generated by a scan counter which provides column and row signals. These signals are coupled to a high speed multiplexer which selects between the addresses that are coupled to the memory. It selects between either scan counter addresses or processor generated addresses.

The system disclosed herein comprises three memory planes each of 16K by 16 capacity. The outputs of the memories are fed to 16 bits shift registers where the data is serialized. All of the shift registers operate in parallel from the common clock. The shift registers couple to a high speed static palette RAM as the addresses to the palette RAM. The data output from the RAM goes to the respective guns on the color monitor or to the black plane for the black and white graphics if using a standard video monitor.

BRIEF DESCRIPTION OF THE DRAWINGS

Numerous other objects, features and advantages of the invention should now become apparent upon a reading of the following detailed description taken in conjunction with the accompanying drawings, in which:

FIGS. 1A–1E show circuit detail for a portion of the high resolution video graphics of the present invention;

FIG. 2 is a general block diagram of the circuit substantially as shown in greater detail in FIGS. 2A–2D.

DETAILED DESCRIPTION

Figure 1B:
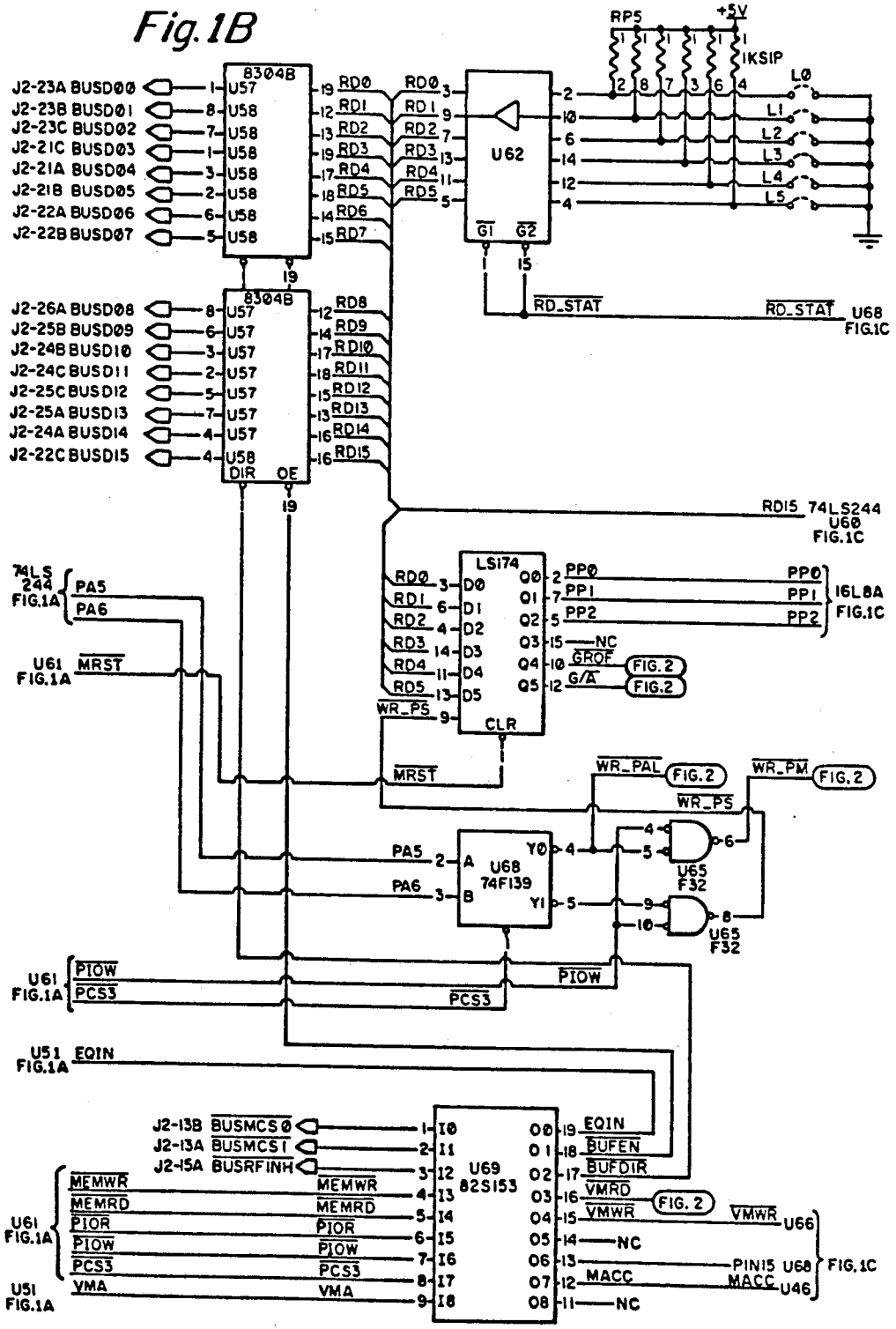

For a detailed description of the video control system of the present invention, reference is now made to the drawings which show all of the circuit elements and associated interconnections for carrying out the features of the present invention. In the drawings, the central processing unit and other parts of the overall computer system are not described in detail. However, connections are noted in the drawings illustrating wherein connections are made to other parts of the computer system including the central processing unit.

In a general overview, the system employs a split bus architecture to minimize the total number of components employed while at the same time providing an expandable upgrade path. This technique permits fast screen updates, on the order of 23 million pixels per second. The system employs four buses including a control bus, a read bus, a write bus, and an address bus. All of these buses intercouple with the central processing unit. The control bus contains signals from the processor which may be a type 186 processor. These control bus signals may include such signals as memory read and write signals, peripheral select signals and data ready signals. These signals are buffered and decoded to provide proper memory timing as to be described in further detail hereinafter.

The read bus RD-BUS and the write bus WR-BUS are the data lines to and from the graphics memory. The read bus RD-BUS is isolated from the write bus WR-BUS so that the processor may read the graphics memory while displaying data to the screen simultaneously. The write bus WR-BUS is split off from the read bus RD-BUS by a tri-state buffer. The write bus WR-BUS then passes to the three memory planes. It also goes directly to the black and white plane (plane 0), and is gated by bi-directional buffers into planes 1 and 2. Reference is made hereinafter to the aforementioned buffers and memory planes.

The address bus BUSA00–BUSA19 is coupled from the aforementioned 186 processor, and is used to read and write graphics data. The addresses for the display data, since they are sequential, are generated by a 14 bit counter. A very high speed 4:1 multiplexer selects between the addresses, where they go to the memories.

The system has three memory planes, each 16K by 16. The outputs of the memories are fed to 16 bit shift registers, where the data is serialized. All the shift registers operate in parallel from common clocks. The shift register outputs go to a high speed static RAM as the address inputs to the RAM. The data outputs of the RAM go to the guns on a color monitor which may be a standard CM-1 color monitor, or to the back plane for the black-white graphics on a VM-1 monitor. Further details are described hereinafter in connection with the aforesaid operation relating to the addressing and the video shift registers and associated RAM.

Prior to initiating a detailed description of the circuitry in the drawings, reference is now made to a discussion on the design considerations associated in particular with graphics operation. In any computer graphics system, there are basically three objectives:

1. The storing of data from the host computer into the graphics memory.
2. Displaying the stored data on the monitor.
3. Retrieving stored data in the graphics memory for communication back to the host computer.

Of the above objectives, generally speaking, the second objective has the highest priority. A user does not want the CRT monitor to blink rapidly, "hash" or go blank for any length of time. Thus, the display objective is relatively critical. As such, graphic systems have been designed so that the host computer can access (read or write) data to the graphics memory only during certain times, so as not to disturb the CRT monitor. The common way to accomplish this is to delegate accesses so as to allow them only during a blank time of the CRT beam; i.e. when the CRT beam is turned off. This occurs during retrace times, when the beam goes from the right side of the screen to the next line down on the left side (horizontal retrace), or from the lower right corner of the screen to the upper left corner of the screen (vertical retrace).

Although the technique of using blank time is easy to implement, the problem is that it is relatively slow. With this technique, the processor can only access the monitor, approximately 6 ms out of a total cycle of 16.6 ms. Of course, the faster the processor/graphics memory is, the more data that can be written in the 6 ms time interval. Another way to access more data is to use a wide data path; i.e. change from an 8 bit processor to a 16 bit processor. However, perhaps the best means of speeding up graphics speed is to use an interleaving technique. This is the technique used in accordance with the high resolution graphics techniques of this invention.

In connection with the objective of providing a proper continuous display, the aforementioned "hash" problem happens when the host computer is trying to access data at the same time that the graphics circuitry is loading the video shift registers. This may be referred to as "memory contention"; when two different circuits essentially vie over who has control of the memory. The contention happens because processor access can happen virtually at any time, while shift register loading happens at a certain time frame. Thus, if the processor tries to access memory when the shift register is being loaded, the register is loaded with incorrect data (usually all ones) and the "hash" effect appears, at least for a brief instant of time on the screen.

In the interleaved technique of the present invention, the memory contention is eliminated by guaranteeing access when the shift register is not being loaded with data to be displayed. Since the shift register, once loaded, is not disturbed by the data being changed on its inputs, one can access memory while the data is being shifted out.

An interleaved memory is controlled by an interleave clock which divides the accesses up between the processor and the shift register. In the preferred embodiment as described in detail hereinafter, there is provided a 50% duty cycle clock of 714 ns period. This clock, identified by the signal DISCYC*. The interleave clock divides the accesses into two equal time slots, each of 357 ns. This means that the processor has 357 ns to access data and the shift registers have 357 ns to fetch the data to be displayed next. This may be referred to as a 1:1 interleave since the time slots are equal.

The previously referred to two accesses are carried out as follows. During a processor access, the 186 processor address is used as the memory address. Data is either written into memory or latched from memory. During a display access, the scan counter address is used to look up the data in all three memory planes. The shift registers are simultaneously loaded and then control goes back to the processor.

Before considering the details of the drawings, reference is now made to timing aspects of the system. In order to provide fast memory access, a fast processor is used with a wide data path. In the disclosed embodiment, the processor may be a type 186 which is a conventional readily available processor circuit. The processor can access 16 bits of data in 500 ns. To also provide proper operation, there are used high speed RAMS of sufficient size to hold all of the pixels for a full screen. The given screen size is 640×400 which provides a total of 256,000 pixels. With the use of a 16 bit processor, this translates into 16,000 16 bit words. A standard 16K RAM array, 16 bits wide can thus be used to hold all the data. In the disclosed embodiment, the RAMS that are chosen are 16K×4, 150 ns dynamic memories. In this regard, refer to the circuit diagram which shows these memories as memory devices U2-U13 (see FIGS. 2A–2C). Each of these is of type TMS 4416-15. The cycle times of these memories is under the aforementioned 357 ns parameter.

The equation for the horizontal scan frequency of the video controller is given by equation 1:

$$\text{Horizontal Scan Freq.} = \frac{\text{(number of visible scan lines)}}{\text{(vertical display time)}} \quad (1)$$

The system of the invention has 400 visible lines. The vertical display time is less than 16.66 ms, and depends on the size of the CRT that is being used. For a 13" tube, this time is 15.15 ms. Therefore, the horizontal scan rate is 26.403 KHz.

The next calculation is for the dot clock frequency for the video shift registers:

$$\text{dot clock freq.} = \frac{\text{(number of horizontal dots)}}{\text{(horizontal display time)}} \quad (2)$$

Figure 4:
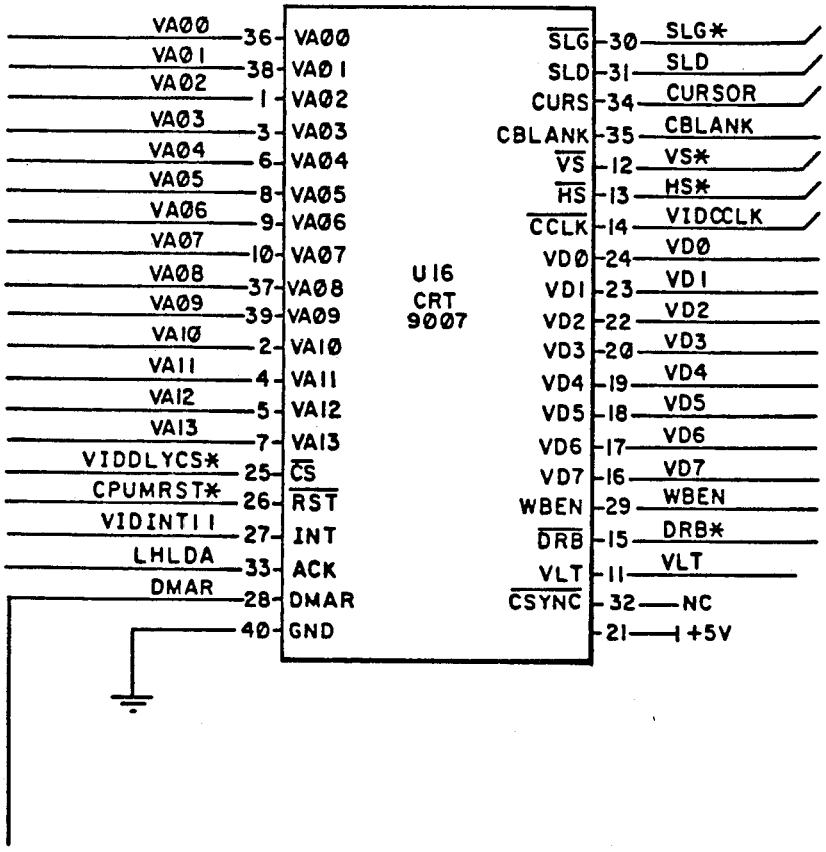
FIG. 4 shows additional circuit details including the video display chip.

The number of horizontal dots is given as 640. The horizontal display time is less than 37.87 us, which is the horizontal period. Since the SMC 9007 video display chip shown in FIG. 4 as circuit U16, which is providing the monitor signals, is character oriented, all the calculations for dot clock are based on this fact. First, the 640 dots are chosen so that 80 characters may be displayed, with each character having an 8 cell width. The CM-1 and VM-1 monitors require at least 2 us sync pulses; the aforementioned SMC 9007 chip can provide 8 character-wide sync pulses. Therefore, the 37.87 us horizontal time may be broken down into 80 characters displayed, eight characters for sync, and 18 for blanking (also due to monitor size). This gives the active display time as 28.59 us and a dot clock frequency of 22.3854 MHz.

Because of the use of a 16 bit wide shift register, the shift register is loaded in accordance with the following.

$$\text{S.R. load} = \frac{\text{(shift register width)}}{\text{(dot clock frequency)}} \quad (3)$$

As indicated previously, this load is 714 ns. A 1:1 interleave requires two time slots, each of 357 ns.

The data from the shift registers goes to a high speed static RAM referred to herein as a palette RAM. This is identified in the drawing in FIG. 2D as RAM U16 which is of type 74S189A. The palette RAM U16 holds a list of color data for the color monitor. The palette RAM has its own input addresses taken either from the shift registers or the processor and also has a data input from the processor. The output from the palette RAM U16 is a data bus to the video monitor, one data bit per gun. The CM-1 monitor which is not shown in the drawings has four inputs which inputs are labeled in the drawing. These inputs are RED, GREEN, BLUE, and INTENSITY. Hence, the palette RAM U16 has four data outputs. The processor can load any of 16, four bit data values into the palette RAM, allowing any address from the shift registers to be any color. Reference is made to this important feature and a further discussion of the details that now follows.

For a discussion of the details of the hardware, reference is now made to the drawings, and in particular FIGS. 1A–1E and 2A–2D. The detailed circuitry described herein basically interfaces with two units, including the processor not actually shown herein, and a video monitor also not actually shown herein. It is understood that the video monitor is of conventional design and is a color monitor. The processor has been identified previously as a 186 processor which is a 16 bit machine and which also is of conventional design. Interconnections are labeled in the drawing to indicate connections to and from these other components of the overall system.

The internal timing signals used in the video controller are derived from a 22.38 MHz dot clock whose output is buffered by means of the inverter U18 pins 10, and 11. The output of this inverter is the signal DOT CLK shown in FIG. 1E. The signal DOT CLK is coupled to video shift registers and also to the high speed counter U19. The signal DOT CLK couples to the clock input at pin 11 of each of the shift registers U22, U24, U26, and U28 (refer to FIGS. 2A and 2C). Similarly, the signal DOT CLK couples to the clock input at pin 2 of the counter or divider U19 shown in FIG. 1E.

Thus, the counter U19 forms part of a video divider chain. The output at pin 12 from counter U19 provides a divide by 8 count to give the character clock signal. The output from pin 12 of counter U19 couples to inverter U18, pins 8 and 9 with the output at pin 8 being the character clock signal CCLK. This signal couples to both delay line U31 and also to the gate U66 at pin 9 in FIG. 1C.

The delay line U31 is of type DDU4-5200 having three separate output taps at 40 ns, 80 ns and 120 ns. The signal at pin 12 is coupled by way of inverter U18, pins 5 and 6 to provide the signal RAS*. At pin 4 there is provided directly the signal MUX. At pin 10 the signal is coupled by way of the inverter U18, pins 1 and 2 to provide the signal CAS*. The signals RAS* and CAS* are for row and column address selection, respectively. All of these signals RAS*, CAS*, MUX as well as DISCYC couple to FIG. 1C.

The signal DOT CLK is also divided by 16 to provide the signal DIS CYC and the negation signal DIS CYC* which is the aforementioned interleaving clock signal. In this regard, refer to the counter U19 and its output at pin 11 which directly provides the signal DIS CYC. This signal is also coupled by way of NOR gate U14 functioning as an inverter, pins 1, 2, and 3 to produce the signal DISCYC*.

The signal DOT CLK is different than a character clock signal generated from the central processing unit and is out-of-phase with this CPU signal. Because the SMC 9007 is used to generate the monitor timing signals (horizontal and vertical sync and blanking) using the out-of-phase character clock of the processor, there is the need for special circuitry to assure that these timing signals are synchronized. A first circuit to carry this out is comprised of D flip-flop U64A. It is noted that the Q output at pin 5 of the flip-flop U64A connects to the load input at pin 9 of the counter U19. The clock input to the flip-flop U64A is the signal 9007 YSYNC.

When the machine is first powered up the master reset signal MRST- goes low for about 100 ms. This forces the counter U19 to load all zeroes to its outputs. The Q output at pin 5 from the flip-flop 64A stays low until the signal MRST* goes away and then a vertical sync signal is issued. The leading edge of the vertical sync signal sets the flip-flop U64A so that the Q output goes high, thus allowing the counter U19 to count. Because the vertical sync signal is aligned with the character clock of the SMC9007, this scheme lines up the graphics clock with the character clock; the graphics clock being the signal CCLK taken by way of inversion at an output of the counter U19 as previously referred to.

However, the other signals from the SMC9007 video display chip delayed from the signal CCLK due to circuitry on the main processor board and due to part-to-part variations between different SMC9007 chips. Therefore, the monitor signals are also lined up using the four bit latch U70 shown in FIG. 1A. The latch U70 is clocked by the signal DIS CYC*. The aforementioned circuits now make all of the SMC 9007 signals power up in a known synchronous state.

Figure 2A:
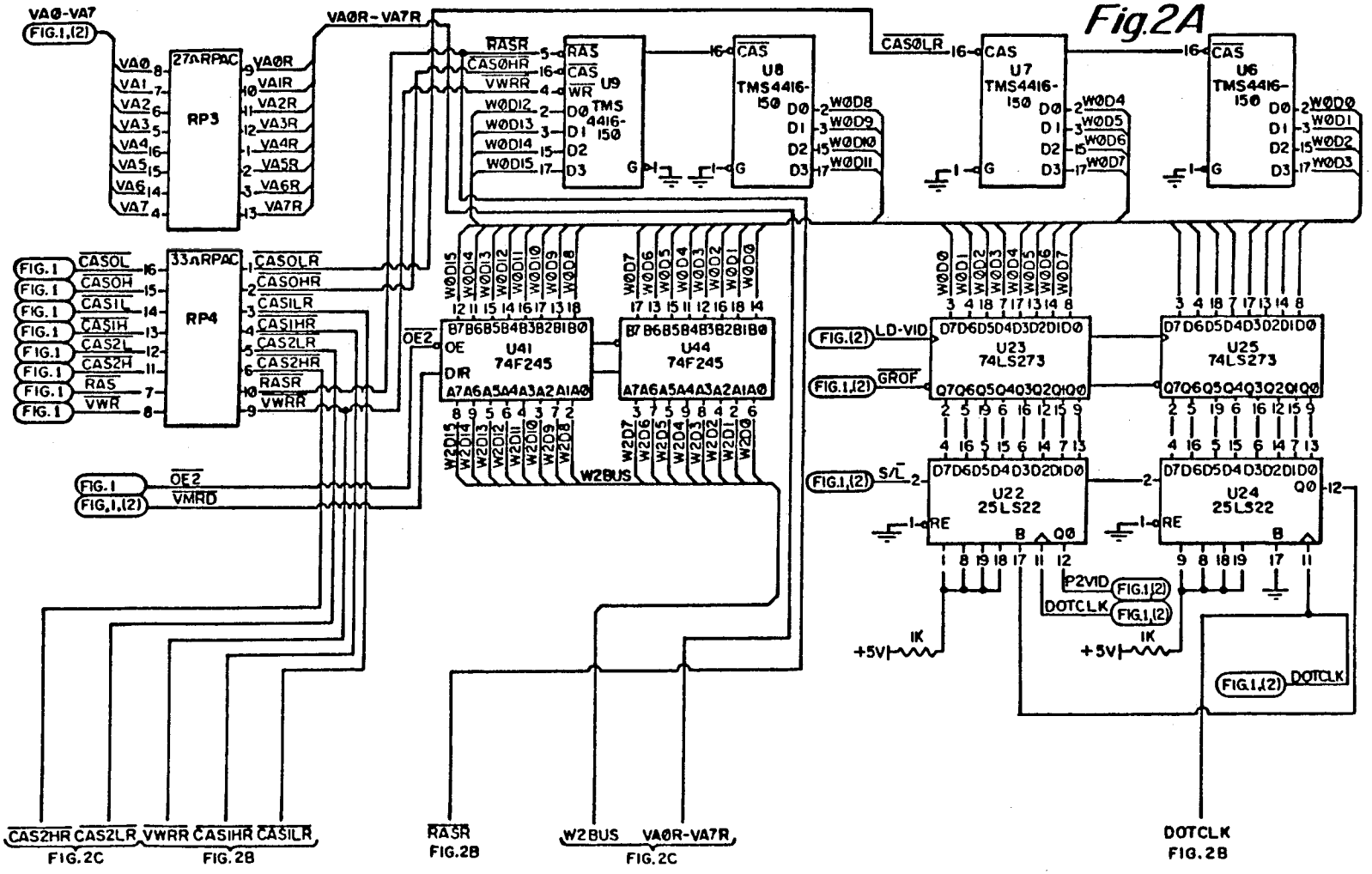
FIGS. 2A–2D show the remainder of the detailed circuitry of the high resolution graphics system of the invention.
Figure 2B:
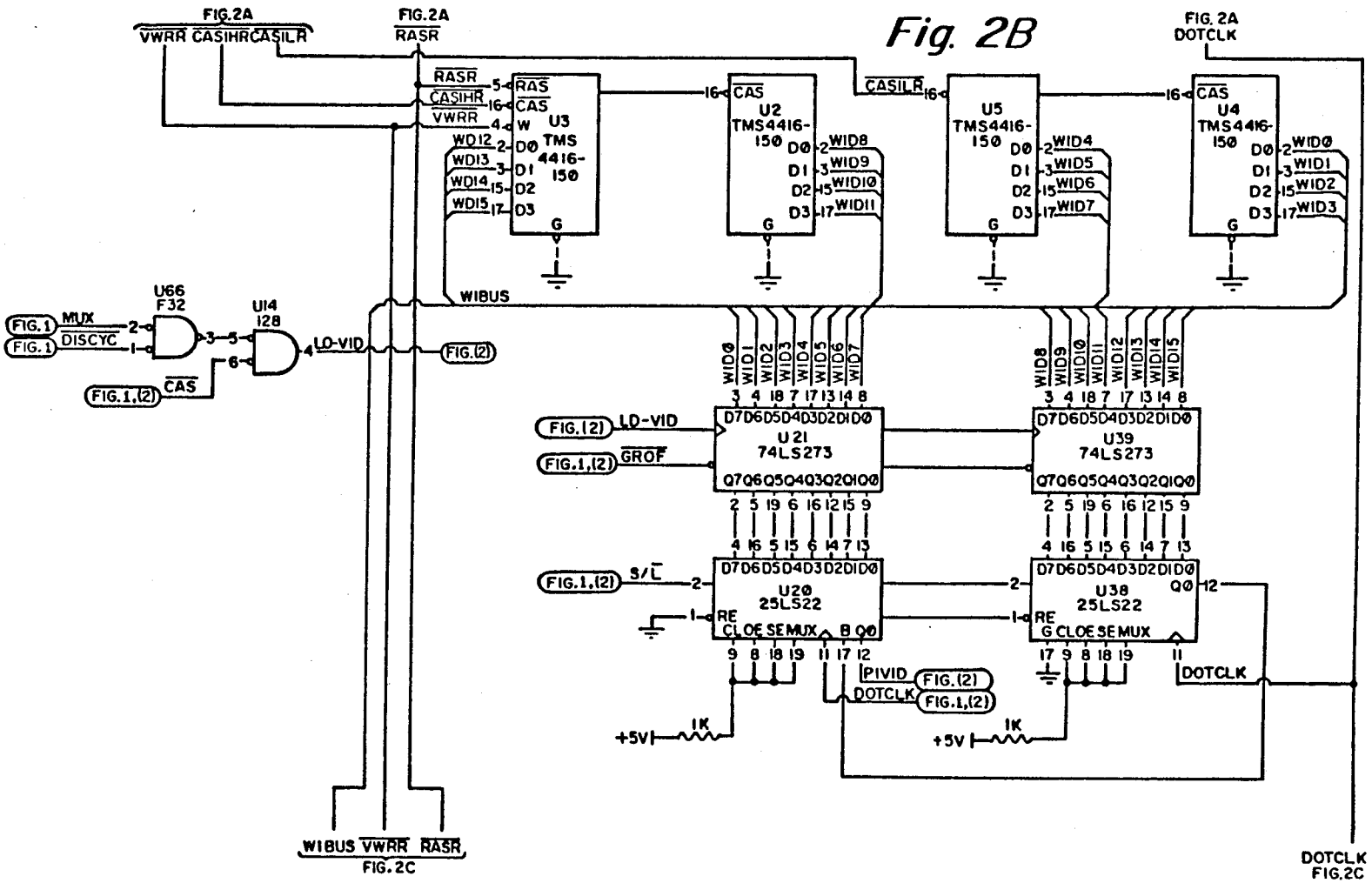
Figure 2C:
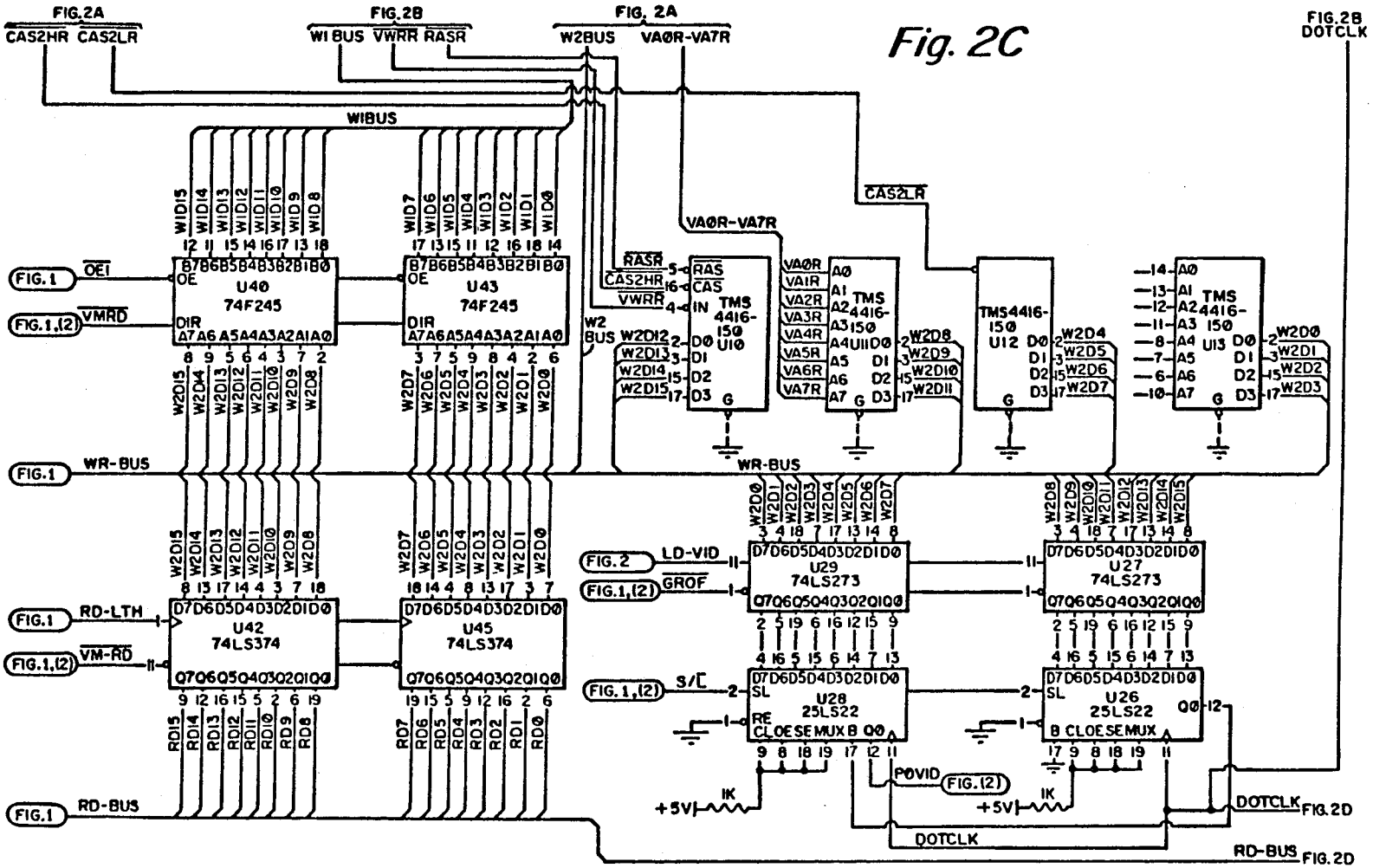
Figure 3:
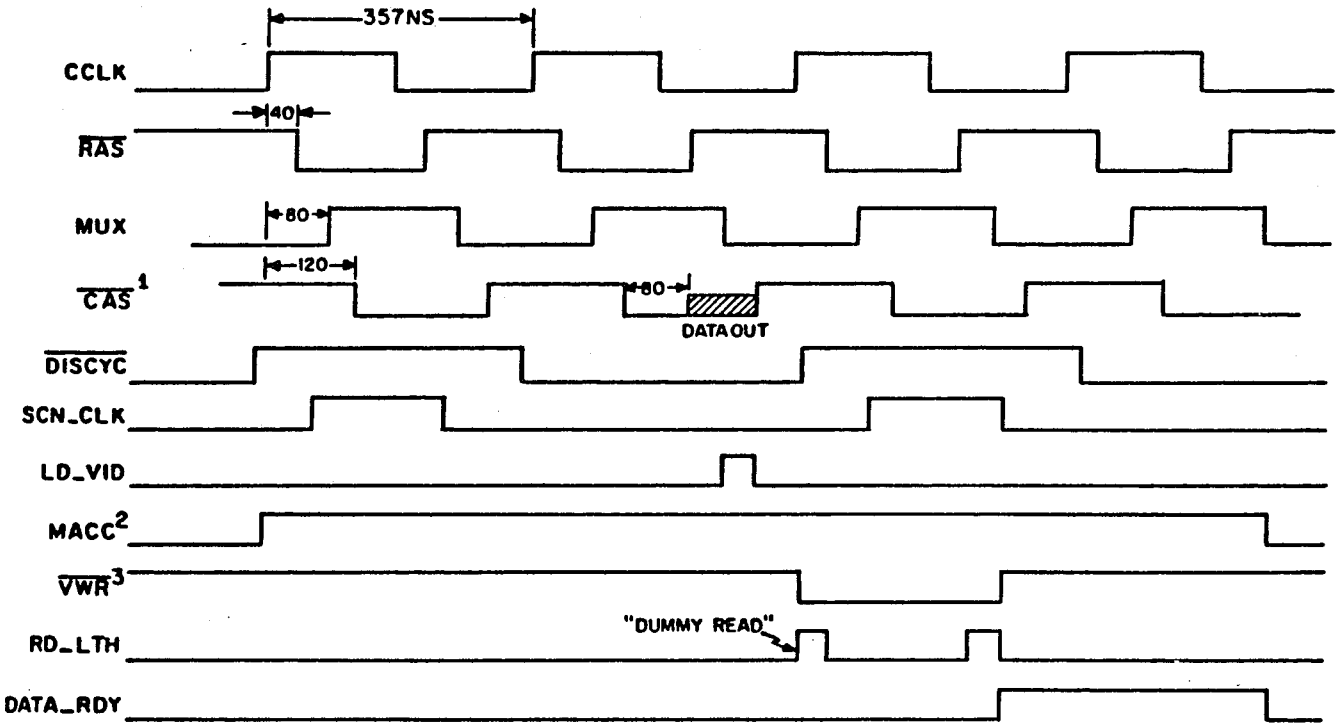
FIG. 3 is a timing diagram associated with the circuitry of FIGS. 1 and 2.

Reference is now made to the timing diagram pertaining to memory timing signals and illustrated in FIG. 3. Reference is made to the counter U19 previously discussed which generates, in addition to the character clock and interleaving clock signals the shift register load pulse signal S/L*. It is noted that in this regard the output of the counter at pin 15 couples by way of inverter U18 pins 12 and 13 to provide the aforementioned signal S/L*. This signal is coupled to pin 2 of each of the shift registers U20, U22, U24, U26, U28 and U38 (see FIGS. 2A–2C). This signal controls the loading of the respective shift registers. With regard to the timing reference has been herein before to the delay line U31. The delay line receives the character clock signal CCLK. The dynamic RAMS U2-U13 (refer to FIGS. 2A–2C) are clocked by delayed versions of the signal CCLK generated from the delay line U31. The row address strobe signal RAS* is the signal CCLK inverted and delayed 45 ns. The signal MUX, which switches the 4:1 address multiplexer between row and column addresses, is the signal RAS* delayed 40 ns. The address multiplexer just referred to is comprised of multiplexer devices U34-U37 shown in FIG. 10. The column address strobe signal CAS* is the signal MUX delayed 40 ns.

In accordance with the system of this invention, in order to conserve address space, all of the memory planes occupy the same physical address space. This technique differs from previous graphic systems which had their memory planes formed as a contiguous memory block.

With regard to the operation relating to the multiple memory planes, there is provided a plane select register U56 9 (refer to FIG. 1B) which is used to select which of the three planes is to be accessed by the processor. During display cycles, this register is essentially ignored. The register U56 also provides control in the event that the video shift registers are enabled. In this regard note the signal GROF* at the output pin 10 of the register U56. The register U56 also controls what video plane is accessed by the processor. In this regard, note the signal G/A* at output pin 12 from the register U56. The signal GROF* couples to pin 1 of each one of the latches U21 (FIG. 2B), U23 (FIG. 2A), U25 (FIG. 2A), U27 (FIG. 2C), U29 (FIG. 2C) and U39 (FIG. 2B). The signal G/A* couples to inverter gate S38 which in turn connects to gate U67 and pin 10 as illustrated in FIG. 2D.

When the signal GROF* is low, the shift registers are continuously loaded with 0's. When the signal G/A* is high, graphic's data is displayed on the color monitor. On the other hand when the signal G/A* goes low the alpha numeric text from the SMC9007 video character display chip is displayed.

Figures 1, 2C, 2D:
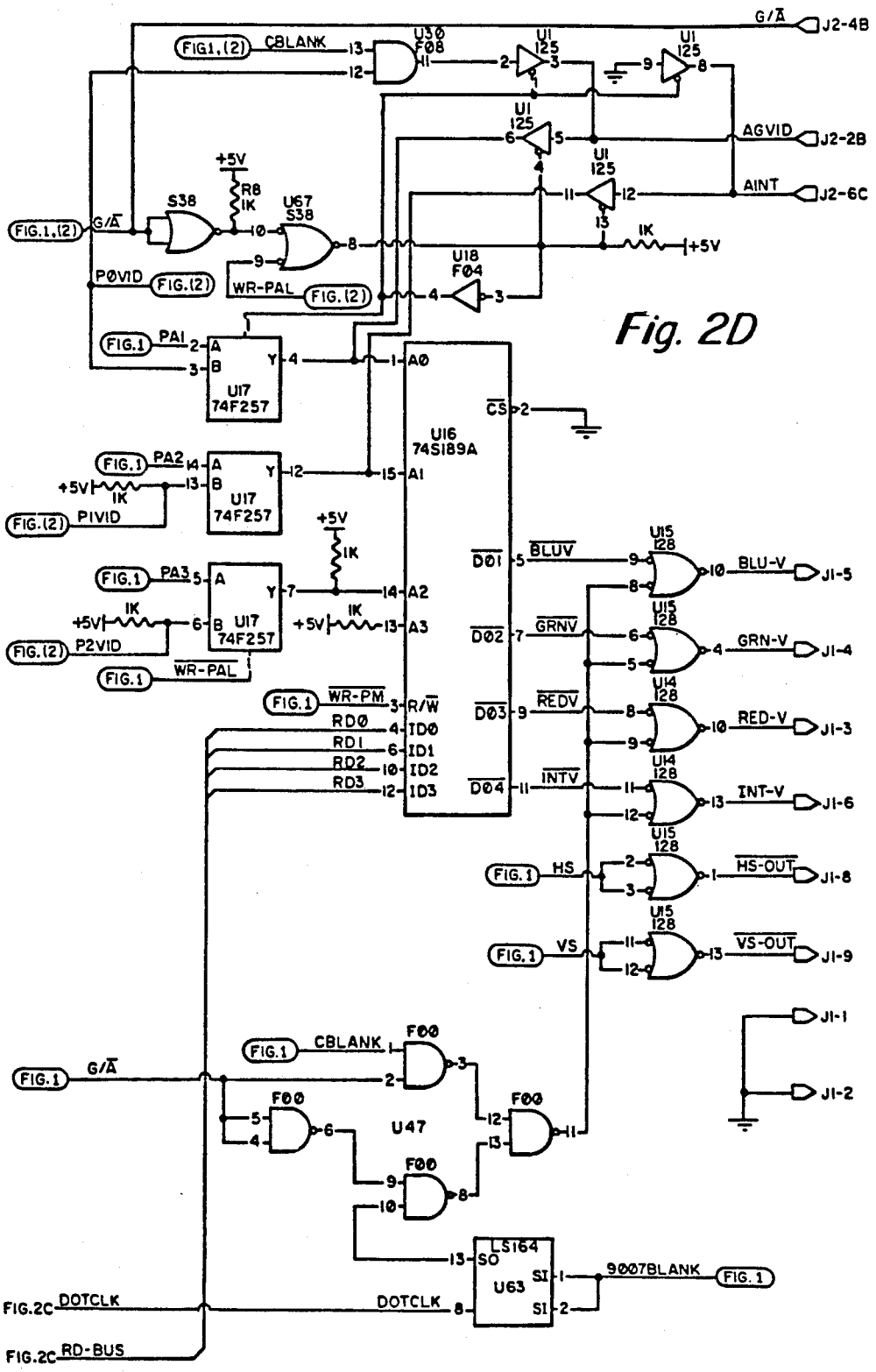
FIG. 1 is a general block diagram of the circuit substantially as shown in FIGS. 1A–1E.

It is also noted that the signal G/A* couples to gate F00A at pin 2 and to gate F00B at pins 4 and 5 as shown in FIG. 2D. The output of gate F00A at pin 3 couples to one input of gate F00D. The output of gate F00B at pin 6 couples to one input pin 9 of gate F00C. Gate F00C at pin 10 also receives an output from the blanking delay register U63. The register U63 of FIG. 2D is of type LS164 and is clocked from the signal DOTCLK. The output of gate F00C at pin 8 forms the second input to the gate F00D. The output of the gate F00D controls the color and intensity output gates U15A, U15B, U14A and U14B coupled from the output of the palette RAM U16. The palette RAM is of type 74S189A.

As indicated previously, the high resolution graphics of the system of this invention provides 640×400 pixels on the VM-1 and CM-1 video monitors. The system has 96K bytes of high speed RAM for storage of graphics data and a user programmable color palette U16 for color assignment. The graphics memory is organized in a planar fashion. If two color video is desired, then plain 0 is installed. Installing planes 1 and 2 provides 8 color video. As indicated previously, all three memory planes occupy the same physical address space. Thus, to determine which of the three planes the CPU is reading or writing to there is provided the aforementioned plane select register U56 (see FIG. 1B) which is set up prior to accessing the graphic's RAM.

With regard to memory organization, the memory starts at address E0000H in the 186 address space. This address corresponds to the upper left of the video screen. The next address is to the right. The lower right corner is the last address. The full screen uses 32,000 bytes or 16,000 words to fully describe a single plane. The system responds to both byte and word accesses. Word accesses are on even addresses only. Either the high byte or the low byte may be transferred during byte accesses.

The graphics memory may be accessed at any time. The high resolution circuitry uses WAIT states to synchronize the data transfer between the CPU and the graphics memory. The average speed at which data is transferred is 16 bits per us. Each bit of the graphics memory represents a DOT (pixel) on a video screen. The MSB (most significant bit) of the bit word is the left most pixel. The LSB (least significant bit) the last pixel to the right.

With regard to the three planes that have been mentioned herein, reference is made to the drawing. The video RAMS U10-U13 (see FIG. 2C) are associated with plane 0. The video RAMS U2-U5 are associated with the plane 1. Finally, the video RAMS U6-U9 are associated with plane 2. In this regard note the outputs signal P0VID at pin 12 from the shift register U28. Also note the output signal PIVID from the output pin 12 from the shift register U20. Also note the output signal P2VID at the output pin 12 from the shift register U22. The signals P0VID, PIVID, and P2VID couple respectively to the multiplexers U17A, U17B and U17C illustrated in FIG. 2D. Each of these multiplexers may be of type 74F257 as noted in the drawing. The video plane signals couple to the B input of each of these multiplexers. The A inputs receive the respective signals PA1, PA2 and PA3. The signals PA1, PA2 and PA3 are directly controlled CPU signals from the input address bus. See FIG. 1A.

The outputs from the multiflexers U17A, U17B and U17C at the respective output pins 4, 12 and 7 couple to inputs A0, A1 and A2 of the palette RAM U16 also illustrated in FIG. 2D. The palette RAM "looks up" a color by forming an address by using the data from each installed plane. Plane 0 is palette address bit A0, plane 1 is palette address bit A1 and plane 2 is palette address bit A2. Palette address bit A3 as noted in the drawing is tied to a high voltage by way of a resistor at pin 13 to the palette RAM. This maintains the A3 input to the palette RAM at a high or one state. If a plane is not installed, the palette address bit is a 1. Therefore, if plane 0 contains a 1, plane 1 a 0 and plane 2 a 0 the palette would "look up" the color at address 1001 in the palette memory.

As indicated previously, because there are three memory planes at a maximum, there can be up to 8 colors displayed at once on the screen. The CM-1 color monitor can display 15 colors. Therefore, any of the available 15 colors up to 8 at a time may be displayed.

In accordance with one feature of the present invention it is to be noted that the CPU may write the palette to change the color look up table. The palette is located in the 186 processor I/O space and is on word (even address) boundaries. The 186 processor uses PCS3 as the I/O port decode for graphics.

As far as the programming is concerned, the palette appears to the programmer as 16 word addresses, starting at I/O address 0180H. The palette is a write-only device. I/O address 0180H is the first palette address, 0182H is the second, etc. Data is stored in the palette by data bits D0–D3. In this regard, note the inputs to the palette ram U16, signals RD0–RD3 to respective pins 4, 6, 10 and 12. The control is carried out by means of a signal at pin 3 which is signal WR-PMS. The upper data bits are ignored. In this regard also recall that these addresses are not the addresses formed to "look up" a color or a particular pixel. Those were addresses A0–A3 shown in the diagram of the palette RAM U16. The four data outputs from the palette RAM, signals D01–D04 are taken at respective pins 5, 7, 9 and 11.

Although a program may access the palette RAM U16 at any time, it is possible to generate an undesirable "tear" or horizontal bar on the screen during a palette write from the CPU. To prevent the video monitor from doing this, the palette RAM is written to only during the vertical blank time. The SMC9007 video controller has a status register which reflects the status of the vertical sync signal. Also, the SMC9007 can provide interrupts to the CPU each vertical sync. It is up to the individual programmer which option is preferred.

With respect to the generation of colors, reference is again made to the palette RAM U16. The data in the palette RAM is tied to the video guns of the CN-1 color monitor in accordance with the table below. It can be seen that the data signal D0 controls the blue gun, D1 controls the green gun, D2 controls the red gun, and D3 controls half intensity. A "1" for data D3 is full intensity and a "0" is half intensity. The table shows possible colors verses data bits.

| D3 | D2 | D1 | D0 | COLOR ON CM-1 |
|---|---|---|---|---|
| 0 | 0 | 0 | 0 | black |
| 0 | 0 | 0 | 1 | dark blue |
| 0 | 0 | 1 | 0 | dark green |
| 0 | 0 | 1 | 1 | dark yellow |
| 0 | 1 | 0 | 0 | dark red |
| 0 | 1 | 0 | 1 | dark magneta |
| 0 | 1 | 1 | 0 | dark cyan |
| 0 | 1 | 1 | 1 | gray |
| 1 | 0 | 0 | 0 | black |
| 1 | 0 | 0 | 1 | blue |
| 1 | 0 | 1 | 0 | green |
| 1 | 0 | 1 | 1 | yellow |
| 1 | 1 | 0 | 0 | red |
| 1 | 1 | 0 | 1 | magneta |

-continued

| D3 | D2 | D1 | D0 | COLOR ON CM-1 |
|---|---|---|---|---|
| 1 | 1 | 1 | 0 | cyan |
| 1 | 1 | 1 | 1 | white |

Because, as mentioned previously, the three memory planes occupy the same address base, there has to be a way to determine which one of the memory planes the CPU is trying to read or write to. This is done by writing the proper data into the plane select register U56. The plane select register is I/O mapped as address 01A0H. It is write only and is 6 bits wide using data bits D0–D5. In this regard, note the 6 inputs RD0–RD5 to the data inputs D0–D5 of the select register U56. The register U56 is of type LS174. The signals RD0–RD5 are derived from the CPU data bus signals BUS D00-BUS D05. The plane select register U56 has basically three function. First, it selects Which plane of memory the CPU has access to. Only one plane at a time is selected. If more than one plane is selected then the register deselects all planes. Second, the register determines if the graphics planes are displayed or turned off. If they are turned off, the address into the palette is 08H, i.e. the plane data is forced to a 0. This does not erase the data in the planes, but simply forces the palette address to 08H. Third, the register determines if addresses into the palette are from the internal memory planes or from the SMC 9007 video memory.

In the following table is presented a chart for the bits contained in the plane select register U56 and their associated function.

| BIT | FUNCTION |
|---|---|
| 0 | Select plane 0 |
| 1 | Select plane 1 |
| 2 | Select plane 2 |
| 3 | No connection |
| 4 | Graphics on/off |
| 5 | Graphics/Alpha switch |
| 6 and 7 | No connection |

To select a particular plane, a "1" is in the corresponding bit while the remaining two plane selects are "0". If plane 1 is to be selected, then data bits D0 and D2 contain a "0" while data bit D1 contains a "1". The graphics on/off bit which is bit D4 contains a "1" to turn on (display) the graphics data in the installed planes. A "0" forces the palette to ignore the memory plane data and display the color contained at palette address 08H corresponding to processor 186 I/O 0190H. The graphics/alpha bit, namely, data bit D5, determines which data is used as palette addresses. If this bit is a "1", the high resolution memory planes are used. If this bit is a "0", the data from the SMC9007 video controller is used for displaying text on the CMl color monitor.

As indicated previously, circuitry is provided for switching between the internal memory planes or external data for use as palette addresses. Refer to the multiplexers U17A–U17C of FIG. 20. The external data is hard wired on the bus as the SMC 9007 video and the video attribute bit intensity. If the external mode is selected, referred to as the alpha mode, the video data is palette address A0 and the attribute bit for intensity is palette address bit A1. Palette address bits A2 and A3 are tied high. This allows four color text to be displayed on the CM-1 color monitor.

In connection with the video RAMS, it is noted that a gated CAS* signal is used to selectively access the different memory planes. In this regard, note the signal CAS 0HR (see FIG. 2A) associated with RAMS U6–U9, the signal CAS 1HR (see FIG. 2C) associated with RAMS U2–U5, and the signal CAS 2HR associated with the video RAMS U10–U13. It is also noted that all of the planes receive the signal RAS*, a common write signal VWRR* and of course also receive memory addresses. The signal CAS* couples to the memory control PAL U55 (see FIG. 1C) and is selectively gated in to access memory. Planes which do not receive the signal CAS* are refreshed by the signal RAS*.

The three plane select lines from the register U56 identified as signals PPO, PP1 AND PP2, along with the signal CAS* go to the memory control PAL U55. Attached hereto is a logic format for the PAL U55. The device U55 is a programmable logic array programmed to send the signal CAS* to each memory plane. The nature of the signal changes but it is noted in FIG. 1C that at the output of the PAL U55 there are signals CAS OH at pin 18, CAS 1H at pin 16 and CAS 2H at pin 14. These signals couple to the package RP 4 (FIG. 2A) and generate corresponding signals CAS OHR, CAS lHR and CAS 2HR. It is this set of signals that controls the video RAMS as noted.

The 186 processor can do either byte or word transfers. Two status lines are provided from the processor which tell external devices, the type of transfer which is about to occur. These signals include a bus high enable signal BHE* and the address line signal PAO (see FIG. 1A). The following chart shows how the lines are decoded:

| PAO | BHE* | TRANSFER |
|---|---|---|
| 0 | 0 | word |
| 0 | 1 | byte on D0–D7 |
| 1 | 0 | byte on D8–D15 |
| 1 | 1 | not used |

Note the signal BHE* coupled to pin 6 of the PAL U55 (FIG. 1C) and the signal PA0 coupled to pin 7 of the PAL U55. The signal BHE* couples from an input latch U61 relating to the CPU signal BUS BHE. The pal U55 receives all of the aforementioned signals along with signal DIS CYC* and signal 186/SCN* and determines which plane is selected and then which of the memories receive the signal CAS*.

There are basically two instances when the signal CAS* is sent. The first is during a display cycle, when the shift registers are loaded. All three planes get the signal CAS*, or a signal derived therefrom, so that the data to be displayed can be fetched. Note that CAS* signal is thus split into upper and lower byte signals for each plane. On a word access, both upper and lower bytes go low during the time the signal CAS* is low. On a byte access, the high or low side goes low, depending on the status of the signals BHE* and PAO.

In connection with the upper and lower byte categories, note for example, with respect to the video RAMS U2–U5, the RAMS U2 and U3 receive the signal CAS IHR relating to upper bytes and the video RAMS U4 and U5 receive the signal CAS ILR relating to lower bytes. The same also applies with respect to the video RAMS U6–U9 and U10–U13. Note the signals CAS OHR; CAS 2HR, and CAS OLR; CAS 2LR.

The second instance when a CAS* signal is sent is during a processor access when the signal 186/SCN* is high. Again, the PAL U55 looks at the status of the signals BHE* and PAO, but also checks the plane select register and then the proper signal CAS* is then generated. The checking of the plane select register occurs by virtue of the inputs P0, P1 and P2 that couple from register U56 to the PAL U55.

It is noted that in addition to the column address select signals at the output of the PAL U55, there are also provided output enables for planes 1 and 2 referred to as signals OE1* and OE2*. These signals are used to enable the bidirectional buffers U40, U41, U43 and U44. See FIGS. 2A and 2C. Each of these buffers is of type 74F245. These buffers isolate the planes from each other. Plane 0 does not need such a buffer since it is on the bottom of the write bus. This topology allows any number of additional planes to be easily added. These signals go low when their associated plane is being accessed by the 186 processor. In this regard note the signal OE1* coupled to buffers U40 and U43 (FIG. 2A) and the signal OE2* coupled to buffers U41 and U44 (FIG. 2A).

The buffers U40 and U43 along with U41 and U44 have their terminals A0–A7 coupled to the write bus (WR–BUS). This is referred to herein also as the signal W2BUS. At the terminals B0–B7 of these bidirectional buffers, are identified the signals WID0–WID15 associated with buffers U40 and U43 and signals WOD-0–WOD15 associated with dibidirectional buffers U41 and U44. It is also noted that there are provided 8 bit latches U42 and U45. Each of these is of type 74LS374. The data side of each latch corresponding to data terminals D0–D7 couples to the write bus WR-BUS. The Q output sides identified as outputs Q0–Q7 couples to the read bus. Note the signals RD0–RD15 coupling to the read bus signal RD-BUS.

The graphics memory starts at system address E0000H.

Although there are three 16K memory planes, each is mapped at address E0000H. In this regard refer to the comparator U51 shown in FIG.1A which is a device of type 74LS85 having A inputs A0–A3 and B inputs B0–B3. The input B0 is tied to ground and inputs B1–B3 are tied to a positive voltage. The address lines PA1-6–PA19 are coupled to the respective A0–A3 inputs of the comparator. Thus, the comparator 51 looks at the addresses and issues a valid graphics memory address when an "E" is detected on the upper address lines. Also, the comparator is gated by the signal EQIN which is generated by the logic array U69 shown in FIG. 1B. The array U69 may be of type 825153 and may be a programmable array logic. The comparator U51 is gated by the signal EQIN so that the false accesses are blocked when the SCM9007 controller is transferring video in memory.

When a valid address is detected, the array U69 determines if a read or write is requested. Depending on the access, the signal BUFDIR* switches the data bus buffers U57 and U58 of FIG. 1B to the correct direction. Note the signal BUFDIR* at pin 17 at the array U69 coupling to pin 1 of the bidirectional data buffers U57 and U58. Also note the signal BUFEN* at the output pin 18 of the logic array U69. This signal enables the data bus for the access. This signal couples to the enable input at pin 19 of the buffers U57 and U58. The logic array U69 then asserts the signal MACC, signifying a valid memory access is requested. This-signal couples to the memory arbitrator flip-flop U48 (FIG. 1C) and also couples to gate U46 at pins 1 and 2.

The memory arbitration logic is comprised of two flip-flops U48 and U64. The flip-flop U48 is a J-K flip-flop of type LS73. Flip-flop U64 is a clocked D-type flip-flop of type F74. The assertion output of the flip-flop U64 is the signal DATA-RDY. The data input to the flip-flop U64 at pin 12 is the signal PUP which is taken from the counter U19 of FIG. 1E. The flip-flop U64 is clocked at pin 11 from the output of the gate U66 at pin 11. The J-K flip-flop U48 has at its assertion output at pin 12 the signal 186/SCN*. The K input to the flip-flop U48 is grounded and the J input is the signal MACC previously referred to. The flip-flop U48 is clocked from the output of gate U30 at pin 8. The gate U30, pins 8, 9 and 10 determines when the shift registers are loaded.

The assertion output of the flip-flop U48 also connects to gate U30 at pin 2 with the output of gate U30 at pin 3 being the read latch signal RDLTH. The negation output from the flip-flop U48 couples to gate U66 at pin 5. The other input to the gate U66 at pin 4 receives a signal VMWR*. The output from the gate U66 at pin 6 is the signal VWR*. This signal controls, inter alia, the buffers U59 and U60 also depicted in FIG. 1C. The gate U66 pins 4–6 assumes that the signal VWR* is asserted only upon a write request. In connection with the memory arbitration circuitry, it is also noted that the gates U66 pins 8–10 and U66 pins 11–13 determine the end of access and involve a resetting of the flip-flop U48. The output of the gate U66 at pin 11 also clocks the flip-flop U64.

The system of the invention uses a "data ready" handshake scheme for external memory. In this technique the 186 processor automatically goes into a WAIT state after requesting access. It is then up to the external memory to assert the signal ARDY when the access is completed. The processor then goes out of the WAIT state, and the external device clears the data-ready signal before the next processor 186 memory cycle.

Figure 1C:
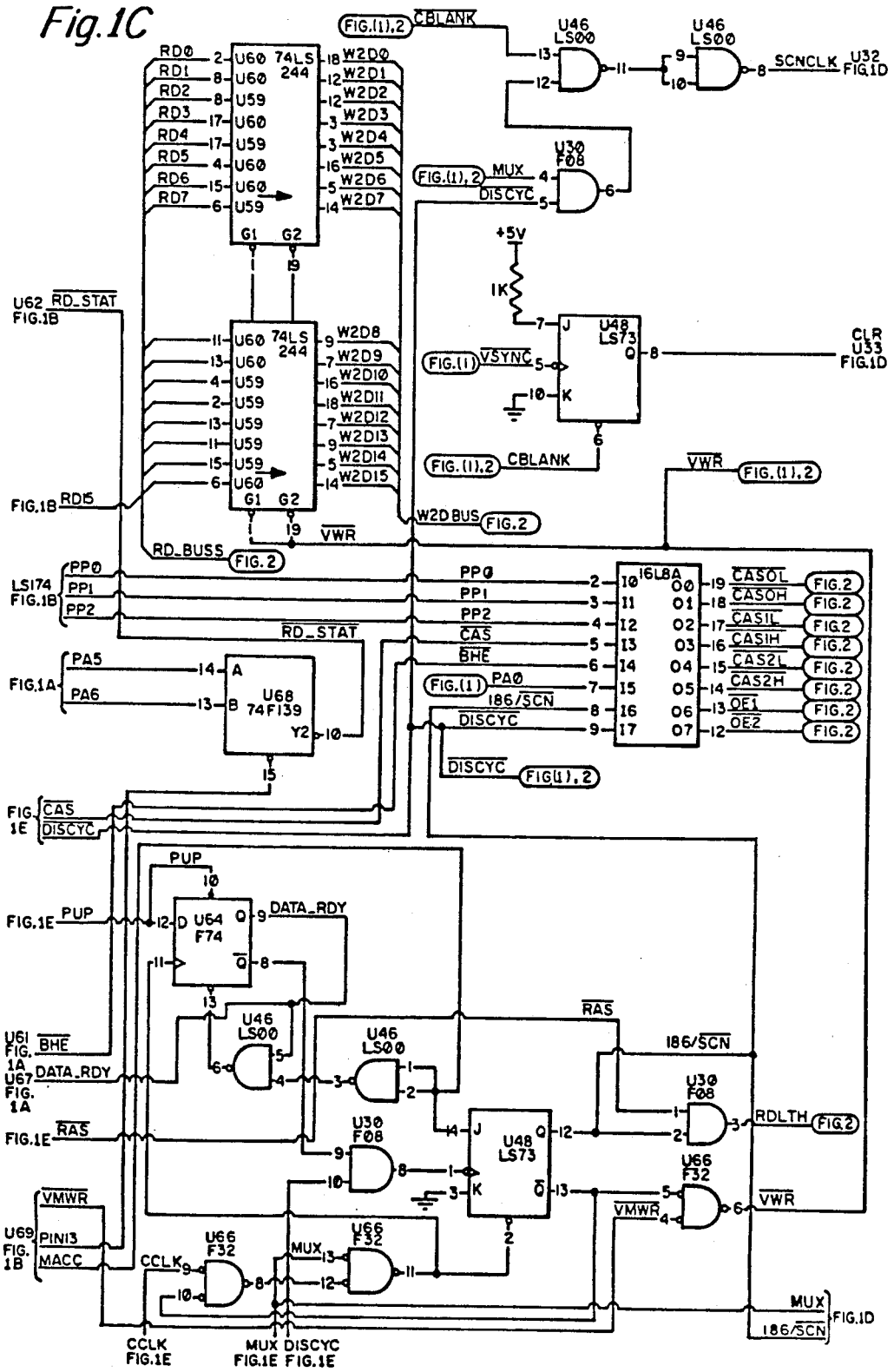
Figures 1C, 1D, 2:
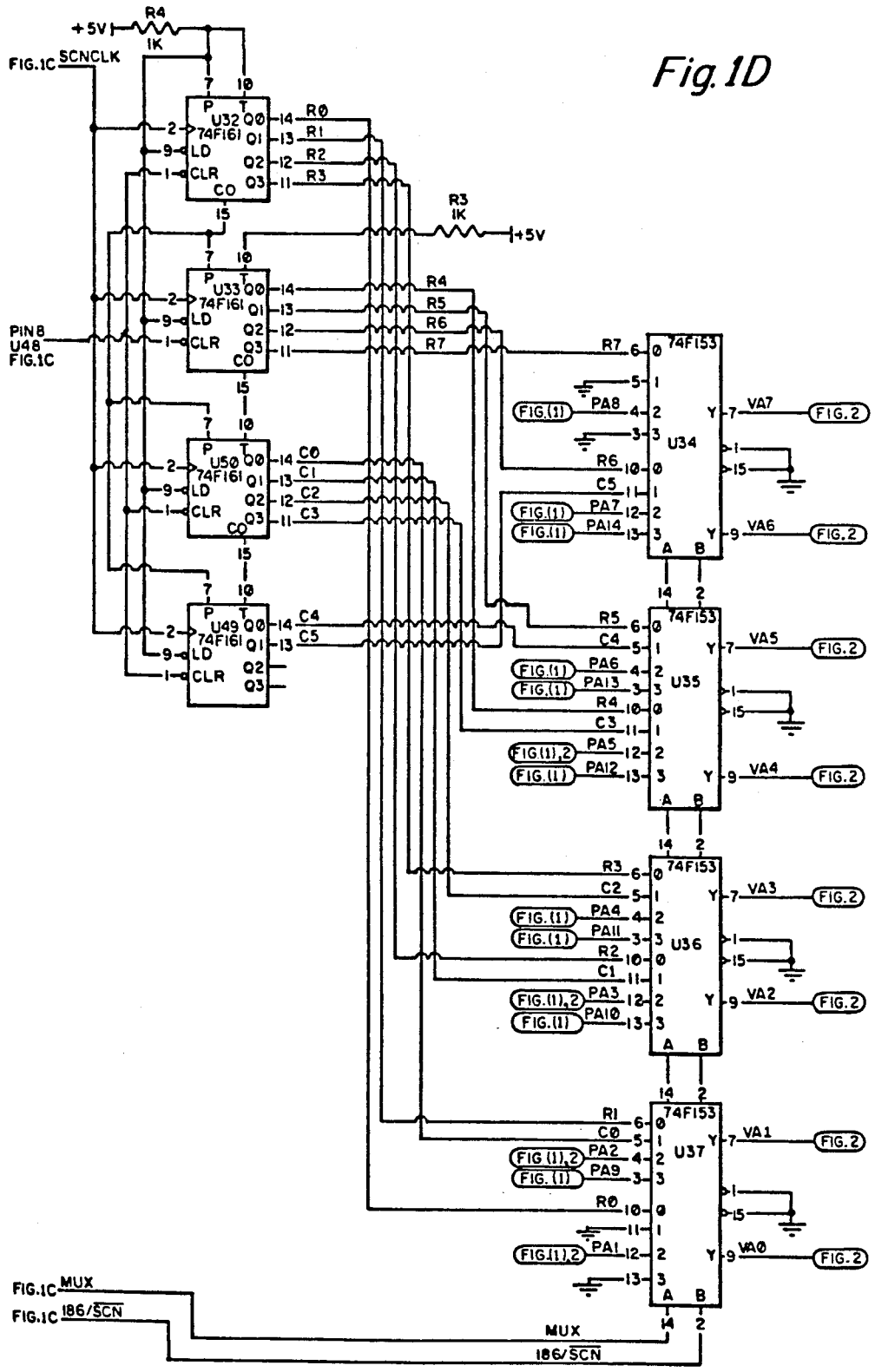
Figure 1E:
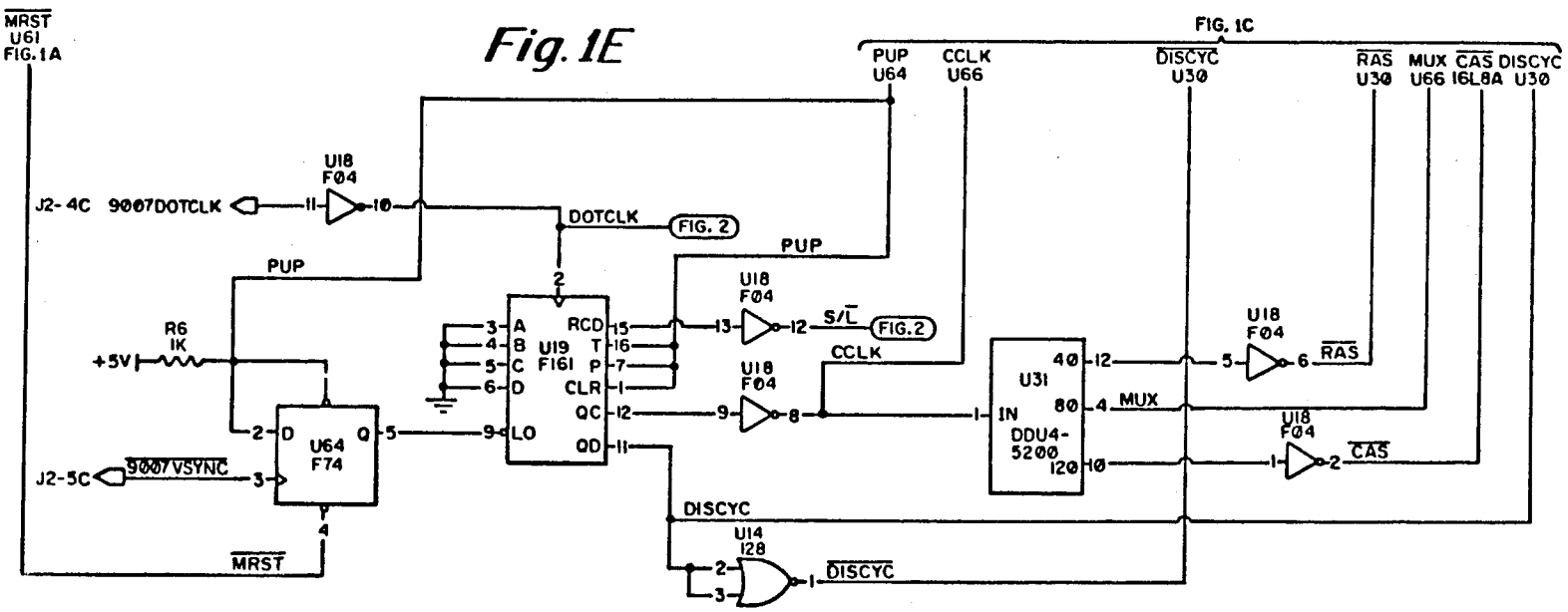

FIG. 1C also shows the AND gate U30 pins 4 and 5 as inputs and pin 6 as an output. This gate senses whether the signal DISCYC is low thus signifying that the shift registers have been loaded and a processor access can now occur. As soon as the signal DISCYC goes low, the flip-flop U48 at pin 1 clocks the signal MACC which appears at pin 14 and which is high to the Q output of flip-flop U48 at pin 12. This makes the signal 186/SCN at the output pin 12 go high which switches the address multiplexers U3414 U37 (FIG. 1D) from the scan counter addresses to the processor addresses and similarly, the Q* output of the flip-flop U48 at pin 13 goes low, which enables the video writes signal, VWR*. The gate U66 pins 4, 5 and output pin 6 makes sure that the signal VWR* is asserted only if a write has been requested. Also, the Q output of pin 12 from flip-flop U48 is gated with the signal RAS* to form the read latch signal RDLTH which clocks the two 8 BIT latches on the read bus, namely latches U42 and U45. Note the input clock signal at pin 1 which is a signal RDLTH coupling to both 8 bit latches U42 and U45 (FIG. 2C). These latches may be of type 74LS374.

It is noted that the address multiplexers U34-U37 each have A and B inputs. The aforementioned signal 186/SCN* is coupled in common to all of the B inputs of these multiplexers. When this signal is high it switches the multiplexers from the scan counter addresses to processor generated addresses. The input A inputs are tied in common from the signal MUX. In this regard the R0–R7 signals and C0–C5 signals are the scan counter signals and the processor generated addresses are the PA1–PA14 addresses. By way of example, with respect to the multiplexer U35 pins 5 and 6 along with pins 10 and 11 receive scan counter addresses and pins 3 and 4 along with pins 12 and 13 receive processor generated addresses. From the multiplexers the signals are identified as signal VA4 at pin 9 and VA5 at pin 7. Similar arrangements occur with respect to the other multiplexers U34, U36 and U37.

The end of an access is basically determined by the gates U66, pins 8–10 and 11–13. The end of an access is determined when the signals CCLK and MUX are both low. When this occurs, the flip-flop U64 is clocked from the output of gate U66 at pin 11 thus asserting the data ready signal DATA-RDY. This signal is driven to the bus in an inverted state by open collector driver U67, pins 1–3 shown in FIG. 1A. The control then waits until the processor acknowledges the access. The signal MACC then goes low after the access, which clears the flip-flop U64 by way of gates U46, pins 1–3 and U46 pins 4–6. This then drops the data ready signal DATA-RDY. The cycle is now completed and the logic is ready for the next request.

Additional circuitry described in the drawings is concerned with displaying the graphics on the CRT monitor. As mentioned previously, the graphics planes are mapped to the screen so that the upper left corner of the monitor is address E0000H, with increasing addresses going to the right. To synchronize the display properly, there is provided a scan counter (FIG. 10) which is composed of four separate counters U32, U33, U49 and U50. Each of these counters may be of type 74F161. These counters have a clock input at pin 2, a load input at pin 9 and a clear input at pin 1. The clock input is the signal SCNCLK taken from NAND gates U46 pins 8–10 and pins 11–13. The signal SCNCLK is derived from the signal CBLANK* and also from the two inputs to the gate U30 at pins 4 and 5, namely, the signals MUX and DISCYC*. The output of gate U30 at pin 6 couples to pin 12 of gate U46. Gate U46 at pins 9 and 10 are tied together and this gate functions as an inverter with the output at pin 8 being the signal SCNCLK for clocking the scan counter.

The scan counter is reset each vertical retrace from the flip-flop U48A at its Q output, pin 8. The flip-flop U48A is of type LS73 and is a J-K flip-flop. The J input is tied to a positive voltage and the K input is tied to ground. The clock input at pin 5 to the flip-flop U48A is the signal VSYNC*. The output from the flip-flop U48A at pin 8 ties to the clear inputs of each stage of the scan counter at pin 1. Thus, the vertical sink signal VSYNC* clears the counters to scan address 0 corresponding to processor address E0000H until the signal CBLANK goes low thereby clearing the flip-flop U48A. Note the signal CBLANK coupling to the reset input of the flip-flop U48A.

The signal CBLANK is the composite blank signal, and is low during active display time.

The scan counters U32, U33, U49 and U50 are clocked by the signal DISCYC* gated by the signal MUX and the signal CBLANK*. This clocking signal is the aforementioned signal SCNCLK. The gating occurs by way of the aforementioned gate U46 pins 8–10, gate U46 pins 11–13 and gate U30 pins 4–6. This clocking assures that the counters advance during active display times. The scan counters produce 8 row outputs R0–R7 corresponding to the scan counters U32 and U33. The outputs R0–R3 are from the counter U32 and the outputs R4–R7 are from the counter U33. The scan counter also produces six column outputs C0–C5. The output C0–C3 are taken from the counter U50 and the output C4 and C5 are taken from the counter U49. The row outputs R0–R7 along with the column output C0–C5 couple to the 4:1 multiplexer which is comprised of multiplexer circuits U34–U37.

As noted in the drawing, the row outputs couple as follows. Signals R0 and Rl to multiplexer U37 signals R2 and R3 to multiplexer U36 signals R4 and R5 to multiplexer U35 and signals R6 and R7 to multiplexer U34. With respect to the column outputs, output C0 couples to multiplexer U37, outputs C1 and C2 couple to multiplexer U36, outputs C3 and C4 couple to multiplexer U35 and output C5 couples to multiplexer U34. The column and row outputs always couple to the 0 and 1 inputs of these multiplexers either at pins 5 and 6 or at pins 10 and 11. These are the scan counter inputs to the multiplexers. The processor inputs are at pins 3, 4, 12 and 13. These column and row outputs from the scan counter address the graphics memory during display cycles. The outputs from the multiplexers are identified as signals VA0–VA7. These signals couple to the package RP3 (FIG. 2A) shown in the drawing and the outputs therefrom are converted to signals VA0R–VA7R couple to the graphics memory.

The graphics memory is comprised of 12 dynamic RAMS. Each dynamic RAM is of type TMS 4416-15 and each is a 16K by 4 dynamic RAM. The graphics memory is arranged in three planes. The first plane is comprised of RAMS U10–U13 (FIG. 2C), the second plane is comprised of RAMS U2–U5 (FIG. 2B) and the third plane is comprised of RAMS U6–U9 (FIG. 2A). The plane 0 is the black and white plane and as mentioned is comprised of RAMS U10–U13. The other memory planes are added to upgrade to color. Each plane has four RAMS and also comprises two latches of type 74LS273 and also two shift registers of type 25LS22. Thus, the plane 0 has latches U27 and U29 and shift registers U26 and U28. The plane 1 has latches U21 and U39 and shift registers U20 and U38. The plane 2 has latches U23 and U25 and shift registers U22 and U24. The latches of type 74LS273 have a clock input which receives the signal LD–VID. These latches also receive the signal GROF*. The shift registers are loaded by means of the signal S/L*. The output plane video signals are taken at pin 12 of one of the shift registers of each pair. Thus, the signal P0VID is taken at pin 12 of shift register U28. The signal PIVID is taken at the output pin 12 of the shift register U20. The signal P2VID is taken at the output pin 12 of the shift register U22. These signals P0VID, P1VID and P2VID couple to the multiplexers U17A, U17B and U17C. These multiplexers also receive processor addresses PA1, PA2 and PA3 respectively.

In addition to the latches and shift registers, there are also provided bus isolation buffers U40, U41, and U43, U44. These buffers are associated only with planes 1 and 2. It is noted that the write bus (signal WR-BUS) couples directly to the latches U27 and U29. However, the write bus couples by way of bus isolation buffers U40 and U43 to the bus W1-BUS, and also couples by way of bus isolation buffers U41 and U44 to the bus W0-BUS. The bus isolation buffers U40, U41, and U43, U44 are necessary because during display cycles all three planes are simultaneously reading data out of their memories into the latches, therefore, each plane needs a dedicated path to its associated latches. Also, the particular type of RAM used has common I/O pins, so data input from the processor cannot be separated from the data going to the latches.

The memory latches such as the latches U27 and U29 of plane 0 hold the data until the shift registers are empty. After 16 pixels have been shifted out, the signal S/L* goes low and the data in the latches are loaded into the shift registers. The output of the shift registers go to a 2:1 multiplexer U17 comprised of separate multiplexer circuits U17A, U17B and U17C. These are the aforementioned signals P0VID, PIVID and P2VID coupling respectively to the B inputs of the multiplexers U17A, U17B and U17C.

The multiplexer selects which address lines go to the palette RAM U16. It selects between processor information represented by the signals PA1, PA2 and PA3; and shift register data as represented by the signals P0VID, PIVID and P2VID.

In connection with the multiplexers U17A, U17B and U17C it is noted that control is provided from the signal WR-PA1*. This signal is normally high and thus the shift register outputs form the palette address. However, during palette writes, when the 186 processor assigns, colors, the signal WR-PA1* goes low, switching the multiplexer to the processor 186 addresses. In this regard also note the signal WR-PM* which controls the read/write operation of the palette RAM U16.

Associated with the multiplexers U17A–U17C is a buffer that permits direct character data from the 9007 video controller In this regard, note the signals AGVID and AINT in FIG. 20. These signals couple to the drivers U1 at respective pins 5 and 12. These drivers are enabled from a signal at the output of the gate U67 at pin 8 derived from the graphics/alpha numerics signal G/A* under control of the signal WR-PA1 which is the assertion of the signal used for control of the multiplexers.

The multiplexer comprised of multiplexer circuits U17A–U17C has tri-state outputs, so that a video from the central processor can be used instead of the graphic data. This allows four color text on the CM-1 monitor. The 9007 video in attribute BIT for intensity can be routed to the palette RAM U16 by buffer U1 which is comprised of four drivers, pins 1–3, pins 4–6, pins 7–9, and pins 11–13. This routing of the 9007 video to the palette RAM is controlled by the status of the graphics-/alpha numerics line, namely signal G/A*. Also, the buffer U1 can send the data from plane 0 to the CPU if desired. Note the signal P0VID coupling to the gate U30 at pin 12 which can couple by way of the buffer Ul pins 2 and 3 to the signal line AGVID.

The outputs of the palette RAM U16 pins 5, 7, 9 and 11 corresponding to data outputs D01–D04 couple to video line drivers U14A, U14B and U15A–U15D. Blanking is also provided at these drivers U14 and U15 by means of NAND gate circuitry including gates F00A and F00D and the blanking delay device U63. The blanking is selected by the discrete 2:1 multiplexer U47 which is comprised of the aforementioned gates F00A–F00D. The blanking is selected so that either the aligned composite blank for graphics is used or the original blanking delayed 8 DOT clocks for text is used. Note that there is associated with the multiplexer U47 a shift register U63 which is of type LS164 and which is used to delay the original blanking signal which is the signal 9007 BLANK shown on the drawing and inputted into the shift register U63. The signal DOTCLK controls the clocking of the blanking shift register U63.

Having now described a preferred embodiment of the present invention, it should now be apparent to those skilled in the art that numerous other embodiments are contemplated as falling within the scope of this invention as now defined by the appended claims.

What is claimed is:

1. A system for generating high resolution video images on a raster scanned video monitor having a matrix array of display positions comprising:

a processor having a control bus, a read bus, a write bus and an address bus, a video memory having a plurality of commonly addressed memory planes, there being an address position in each of said memory planes for each of said display positions, each of said planes containing selected information concerning the display at the display position, video counter means for generating address signals for said video memory in synchronization with said raster scan, multiplexer means, means for applying the output from said video counter means and the address bus from said processor as inputs to said multiplexer, means for applying the output from said multiplexer as the address input to the video memory, means for simultaneously reading information stored at an address position in all planes to control the display at the corresponding display position, means for independently writing information into an address position in a selected memory plane including a write bus for each memory plane, means for separating said write buses including isolation buffers disposed between write buses to demarcate separate write buses corresponding to the number of said memory planes, latch means for isolating the write bus from the read bus, said multiplexer means comprising a plurality of separate multiplexer circuits.

2. A system for generating high resolution video images on a raster scanned video monitor having a matrix array of display positions comprising:

a processor having a control bus, a read bus, a write bus an address bus, a video memory having a plurality of commonly addressed memory planes, there being an address position in each of said memory planes for each of said display positions, each of said planes containing selected information concerning the display at the display position, video counter means for generating address signals for said video memory in synchronization with said raster scan, multiplexer means, means for applying the output from said video counter means and the address bus from said processor as inputs to said multiplexer, means for applying the output from said multiplexer as the address input to the video memory, means for simultaneously reading information stored at an address position in all planes to control the display at the corresponding display position, and means for independently writing information into an address position in a selected memory plane, a shift register means for each of said memory planes, means for applying information read out from each memory plane to the corresponding shift register means, means for reading out the contents of each shift register means in serial fashion, a multiplexer circuit, means for applying the outputs from said shift register means as one input to said multiplexer and for applying the address bus as a second input to said multiplexer, a palette RAM means, and means for coupling the output from said multiplexer circuit as the address input to said palette ram means, multiple output lines from said palette RAM means including color generating lines and an intensity line, and output driver means for coupling the palette RAM means to control said video monitor.

3. A system as set forth in claim 2, including a write bus for each memory plane, means for separating said write buses including isolation buffers disposed between write buses to demarcate separate write buses corresponding to the number of said memory planes, latch means for isolating the write bus from the read bus, and multiplexer means comprising a plurality of separate multiplexer circuits.

* * * * *